US006427843B1

(12) United States Patent
Clark

(10) Patent No.: US 6,427,843 B1
(45) Date of Patent: Aug. 6, 2002

(54) FLOTATION SEPARATION OF VALUABLE MINERALS

(75) Inventor: David William Clark, Gladesville (AU)

(73) Assignee: BOC Gases Australia Ltd., Chatswood (AU)

( * ) Notice: Subject to any disclaimer, the term of this patent is extended or adjusted under 35 U.S.C. 154(b) by 0 days.

(21) Appl. No.: 09/320,530

(22) Filed: May 26, 1999

(30) Foreign Application Priority Data

May 27, 1998 (AU) ..... PP3734

(51) Int. Cl.[7] ..... B03D 1/02

(52) U.S. Cl. ..... 209/164; 209/166; 209/167

(58) Field of Search ..... 209/166, 167, 209/3, 164

(56) References Cited

U.S. PATENT DOCUMENTS

| | | | | |
|---|---|---|---|---|
| 3,655,044 | A | * | 4/1972 | Delaney |
| 3,669,266 | A | * | 6/1972 | Sanders |
| 4,735,783 | A | * | 4/1988 | Bulatovic |
| 4,880,529 | A | * | 11/1989 | Bulatovic et al. |
| 5,074,994 | A | * | 12/1991 | Ray et al. |
| 5,110,455 | A | | 5/1992 | Huch |
| 5,295,858 | A | | 3/1994 | Huch |
| 5,653,945 | A | * | 8/1997 | Gathje et al. |

FOREIGN PATENT DOCUMENTS

| | | | |
|---|---|---|---|
| AU | 37917/95 | | 5/1996 |
| AU | 39027/95 | | 5/1996 |
| CA | 1070034 | * | 1/1980 |
| CA | 2163688 | * | 5/1996 |
| GB | 251171 | * | 4/1926 |

OTHER PUBLICATIONS

Xu, Manqiu et al, "Sphalerite Reverse Flotation Using Nitrogen", Proc. Electrochem Soc., vol. 92–17, Proc. Int. Symp. Electrochem. Miner. Met. Process. III, 3rd, p. 170–190, (1992).*

Rao, S.R.; Martin, C.J. et al, "Possible Applications of Nitrogen Flotation of Pyrite", Minerals, Materials and Industry (Ed. M.T. Jones), Inst. of Mining and Metallurgy, p. 285–293 (1990).*

Volkov, V.I., et al, "Creation of the Technology of Copper–Nickel–Iron Bearing Ore Beneficiation of Talnakh Deposit on the Basis of Flotation with the Use of Inert Gas", Copper 91, Int. Sym 2:335–340 (Pergamon Press), 1991.*

Martin et al, "Complex Sulfide Ore Processing with Pyrite Flotation by Nitrogen", International Journal of Mineral Processing, 26 (1989), Elsevier Science Publishers B.V., Amsterdam.*

Ahn. JH and Gebhardt, JE, "Effect of Grinding Media—Chalcopyrite Interaction on the Self–Induced Flotation of Chalcopyrite", Int. Journal of Mineral Processing, 33 (pp. 243–262)—1991, Elsevier Science Publishers B.V. Amsterdam.*

Derwent Soviet Inventions Illustrated, Section 1, Chemical, vol. W, No. 31, Issued Sep. 9, 1975, Chemical Engineering p. 1, SU 405247, Dec. 1974.

* cited by examiner

*Primary Examiner*—Thomas M. Lithgow
(74) *Attorney, Agent, or Firm*—Joshua L. Cohen; Salvatore P. Pace

(57) ABSTRACT

A process for separating minerals of different mineralogical character. A milled slurry or flotation concentrate is subjected to a first conditioning step (20) followed by a first flotation step (30) followed by a second conditioning step (50) followed by a second flotation step (60). One of the conditioning steps is with an oxidising gas, the other of the conditioning steps being with a non-oxidising gas and an oxidisable surface modifying reagent. The process allows separation of mixtures of valuable minerals by tailoring both the first and second conditioning steps and first and second flotation steps to particular mixed mineral ores.

9 Claims, 1 Drawing Sheet

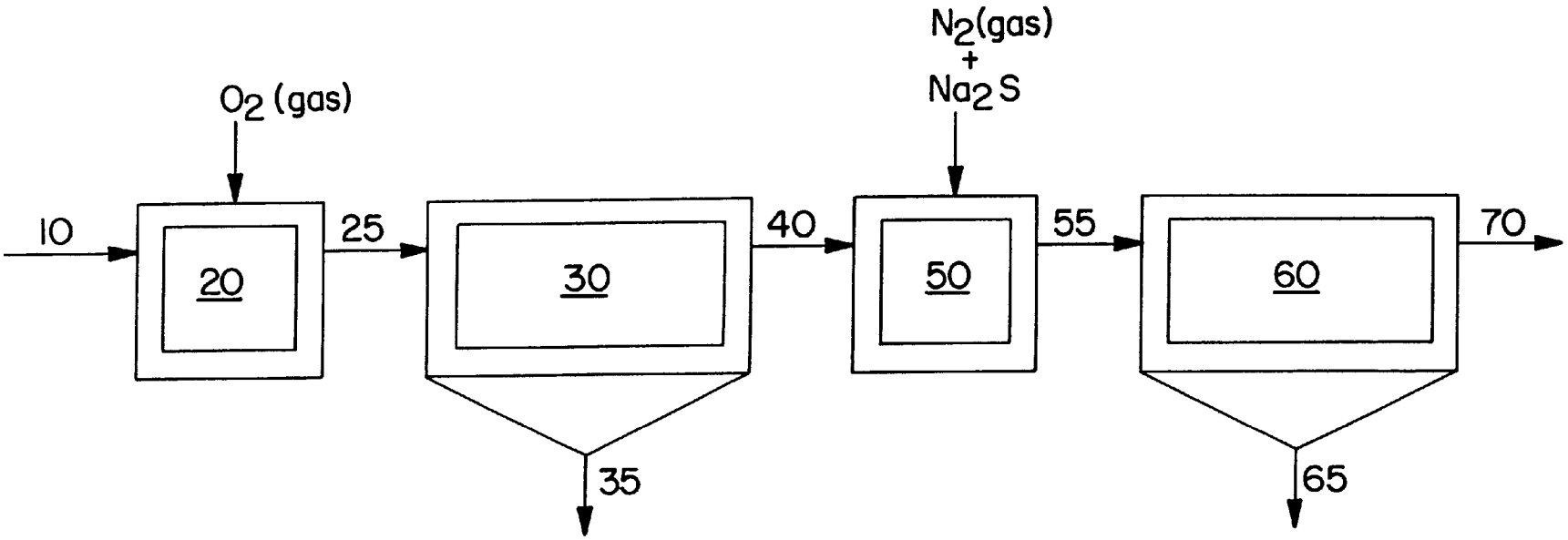
10
O2 (gas)
20
25
30
35
40
N2(gas)
+
Na2S
50
55
60
65
70

FLOTATION SEPARATION OF VALUABLE MINERALS

FIELD OF THE INVENTION

The present invention relates to physical separation of minerals and in particular to the separation of minerals of different mineralogical character.

BACKGROUND OF THE INVENTION

Valuable minerals in ores are commonly present as more than one type of mineral. The types of minerals can range from sulphides e.g. pyrite, chalcocite, pentlandite etc. to oxide such as cuprite, tenorite, smithsonite, zincite.

Each of these minerals can exhibit quite different flotabilities. If one applies a particular flotation process to such a mixed mineral ore, one may obtain partial recovery of the valuable minerals, but a proportion of the valuable mineral or indeed another valuable mineral may be lost. The prior art does not adequately address or provide a process for recovery of the various types of valuable minerals in a mixed mineral ore.

The present invention seeks to overcome at least some of the problems of the prior art or at least provide a commercial alternative thereto.

BRIEF SUMMARY OF THE INVENTION

In a first aspect, the present invention provides a process for recovery of valuable minerals of different mineralogical character from an ore wherein

- a milled slurry or flotation concentrate is subjected to a first conditioning step followed by first flotation step to recover a valuable mineral in the slurry or concentrate is recovered,
- a tailings stream from the first flotation step being subjected to a second conditioning step followed by a second flotation step to recover any valuable mineral in the tailings stream, wherein
- one of the conditioning steps includes conditioning the slurry or flotation concentrate with an oxidising gas containing a gas selected from the group consisting of oxygen and ozone, and
- the other of the conditioning steps includes conditioning the slurry or flotation concentrate with a substantially non-oxidising gas and an oxidisable surface modifying reagent.

In a preferred embodiment, the oxidative conditioning step is conducted first, followed by flotation, and the conditioning step with an inert or non-oxidising gas is conducted second, followed by the appropriate flotation step.

The present invention is suitable for an ore containing a mixture of valuable minerals including sulphidic minerals or non-sulphidic and sulphidic minerals, and non-valuable sulphidic minerals and non-valuable "gangue" material.

Suitable oxidising gases include oxygen, oxygen enriched air and/or ozone. Suitable inert or non-oxidising gases include nitrogen, argon, carbon dioxide, sulfur dioxide or admixtures thereof.

Which oxidisable surface modifying reagents are used will depend on the desired mineral separation and can be chosen as appropriate from either the group containing sodium hydrosulphide, sodium sulphide, hydrogen sulphide, ammonium sulphide, ammonium hydrosulphide or the group containing sulfoxy agents including sodium sulphite, sodium hydrogen sulphite, sodium metabisulphite, sodium bisulphite, sulfur dioxide gas or solution, sulphite agents, K, Ca, $NH_4^+$ salts thereof.

BRIEF DESCRIPTION OF THE DRAWINGS

The FIGURE is a flow chart of a flotation process according to an embodiment of the present invention.

DETAILED DESCRIPTION OF THE INVENTION

As shown in the FIGURE, a milled reagentised slurry, or concentrate from a previous flotation step 10 is fed to a first conditioning step 20 whereby it is conditioned with oxygen to promote the flotation of valuable sulphide minerals. The conditioned slurry 25 is then transferred to subsequent flotation step 30 where flotation is preferably carried out with air as the flotation gas. The concentrate 35 leaving flotation step 30 includes a large proportion of valuable minerals. The flotation tailings 40 leaving flotation step 30 still contain significant quantities of valuable mineral. Not wishing to be bound by any particular theory, it is believed that the valuable mineral is present in stream 40 as partially oxidised sulphide minerals and oxide minerals. These minerals containing valuable metal are not normally conducive to flotation with sulphide mineral-type reagents.

The present applicant has found, however, that it is possible to recover the valuable metals in the flotation tailings stream 40. This flotation tailings stream 40 undergoes a further conditioning step 50 whereby it is conditioned with nitrogen and an inert or nonoxidising gas to substantially remove all dissolved oxygen present. It is also subjected to a surface modifying agent such as sodium sulphite ($Na_2S$). The conditioned slurry 55 leaving the second conditioning step 50 is fed to air flotation step 60 in which the valuable mineral leaving the previous flotation step 30 with tailings 40, is recovered as a concentrate 65. The tailings 70 leaving this last flotation step have very little valuable minerals included.

The present invention is suitable for application to any ore which includes minerals of different mineralogical character including but not limited to copper skams, porphyry copper/molybdenum, supergene enrichment. It is also believed that the process could be applied to the flotation of ores containing copper, lead, zinc and nickel minerals.

The proposed method has significant advantages over conventional flotation processes including the ability to tailor both the first and second conditioning steps and first and second flotation steps to the particular mixed mineral ore undergoing the process.

Further, having a second conditioning step allows an operator to recover valuable minerals which he/she may have expected to recover in the first conditioning/flotation step. To explain, the flotation of some minerals can be readily enhanced by the addition of oxygen. This is particularly true for sulphide minerals. On the other hand, the flotation of some minerals may be reduced by oxidation. In the present invention, if addition of oxygen has decreased the flotation of some valuable minerals, then this is reversed by the application of the inert gas and surface modifying agent in the second conditioning step and any valuable minerals present as, for example, oxide that previously were not floatable can be made floatable.

It should also be remembered that the most common way of producing oxygen and nitrogen gases is by separation of these components from air. Since both these gases are required for the present method, it is possible to select an air separation plant that will simultaneously produce both gases, of the desired purity, on site for the recovery process.

It is expected that both conditioning steps and flotation steps may require some optimisation to match the ore being floated. For example, the duration and intensity of oxygen conditioning and therefore the dissolved oxygen concentration prior to flotation of the first concentration may be tailored to suit the particular ore.

The duration of the oxidative conditioning may depend upon a number of factors such as pulp electrochemical or oxidation-reduction potential; whether the conditioning is a batch or continuous process and the desirability of avoiding over-oxidation of the pulp. Generally, the optimal results in terms of conditioning will be achieved with not longer than 60 minutes conditioning, preferably less than 20 minutes conditioning and more preferably 3 to 12 minutes.

The optimum oxygen addition rate and pulp saturation may be determined for each specific ore type by trial and error. For example, the maintenance of a dissolved oxygen concentration of 6 to greater than 30 mg/l pulp liquor for a period of 3 to 12 minutes may prove effective for many ore types but preliminary testing is advisable.

The oxidative conditioning step may occur prior to flotation or simultaneously therewith. The former strategy is preferred because deleterious components, such as sulphoxy compounds and especially thiosulphate, in the pulp may be destroyed by a pre-oxidation step prior to the addition of collectors, activators and other flotation reagents.

A preliminary oxidation step wherein the oxidising gas is introduced at the mill, where fresh sulphide surfaces may be generated which are most susceptible to activation, or in a primary conditioning stage is advantageous in that, by consuming deleterious components such as abraded iron, poly sulphides and sulphoxy species, undesirable consumption of flotation reagents is avoided and improved activation of the sulphide minerals is consequently achieved. Oxidising gas may also be introduced to the pulp on discharge of the pulp from milling prior to addition of other flotation reagents, eg collectors, frothers etc.

There is no need for the oxidative conditioning step to occur in a single stage. For example, the oxidising gas may be introduced in a preliminary conditioning stage. The remaining flotation reagents may then be added in a secondary oxidative conditioning stage. Thus oxidising gas and other flotation reagents may be introduced in discrete conditioning or other stages. It is not intended here to limit the oxidative conditioning stage. It is intended to illustrate that the introduction of the oxidising gas and other flotation reagents to the circuit may occur in a number of ways promoting the efficiency of the process.

Similarly, the conditioning step with non-oxidising gas, and surface modifying reagent, may be conducted in a discrete conditioning step prior to flotation, but may also occur during milling. Further, conditioning with non-oxidising gas may occur simultaneously with flotation or at any other convenient stage of the flotation operation.

Conveniently, addition of the surface modification reagent to the pulp may be controlled in accordance with the optimal dissolved oxygen concentration or oxidation-reduction potential range for conditioning, (for example, if a sulphur containing reagent, for sulphidisation) which is ideally predetermined by trial and error for each specific ore type of interest. Addition of the reagent is then typically conducted when the monitored oxidation-reduction potential or dissolved oxygen concentration rises above the desired range and discontinued when the oxidation-reduction potential falls below the desired range. The desired range for oxidation-reduction potential would generally fall in the range −100 mV to −1000 mV as measured against silver/silver sulphide electrode ($E_s$). More preferably, $E_s$ would be within the range −200 mV to −600 mV.

The time taken in the conditioning step is of some importance. Generally, in continuous conditioning operations this time should be between 1 and 10 minutes, more preferably 1 to 6 minutes and most preferably 3 to 5 minutes.

EXAMPLE

By way of example, two tests were conducted where 1 kg charges of crushed ore containing various copper minerals assaying 0.48% copper and 0.35% sulphur were slurried in water to obtain pulp density 62 wt % solids and milled in a mild steel rod mill employing stainless steel rods to achieve flotation feed sizing in the region of 40% passing microns.

The milled slurry was then transferred to a 2.5 litre Denver flotation cell and diluted with water to achieve a pulp density 35 wt % solids. The agitator speed was set at 1500 rpm and maintained constant throughout the tests.

TEST 1—CONTROL TEST

The appropriate quantity of sulphide mineral collector was added and the slurry was conditioned for 1 minute. At the completion of collector conditioning an appropriate quantity of frother was added. The slurry was conditioned for a further 1 minute prior to flotation.

Flotation with air was commenced and four rougher concentrates were produced after 1, 3, 6 and 10 minutes respectively of flotation. The flotation products were dried, weighed and assayed for copper content.

Metallurgical results of the test are as follows:

Flotation Performance

| Product | Copper Assay % | Copper Distibution % |
|---|---|---|
| Conc 1 | 35.9 | 70.5 |
| Conc 1 + 2 | 31.4 | 79.5 |
| Conc 1 + 2 + 3 | 28.4 | 81.9 |
| Conc 1 + 2 + 3 + 4 | 25.7 | 83.0 |

TEST 2—PRESENT INVENTION

The same quantity of sulphide mineral collector as Test 1 was added and the slurry was conditioned for 1 minute. At the completion of collector conditioning the slurry was subjected to the first conditioning step of the present invention where $O_2$ gas was added to achieve a dissolved oxygen concentration of 20 ppm for 2 minutes. Then the same quantity of frother as Test 1 was added. The slurry was conditioned for a further 1 minute prior to flotation.

Flotation with air was commenced and two rougher concentrates were produced after 1 and 3 minutes, respectively, of flotation. The slurry was then subjected to the second conditioning step of the present invention where $N_2$ gas was added at 1 lpm to essentially remove oxygen dissolved in the slurry and a surface modifying reagent sodium hydrosulphide (NaHS) was added over 2.5 minutes at a rate to achieve and maintain a sulphide potential of minus 400 mV as measured by a sulphide selective electrode. The quantity of NaHS required to achieve these conditions was 20 gpt.

Flotation with air was commenced and two rougher concentrates were produced after 3 and 6 minutes respectively of flotation. The flotation times were therefore identical to Test 1. The flotation products were dried, weighed and assayed for copper content.

Flotation Performance

| Product | Copper Assay % | Copper Distibution % |
|---|---|---|
| Conc 1 | 37.0 | 71.3 |
| Conc 1 + 2 | 31.0 | 81.5 |
| Conc 1 + 2 + 3 | 27.7 | 83.7 |
| Conc 1 + 2 + 3 + 4 | 23.8 | 85.3 |

The test data indicates that at essentially identical concentrate copper assay the present invention:

Increased overall copper recovery by 2.3%.

The first conditioning step increased copper recovery to Conc 1+2 by 2%.

The second conditioning step increased copper recovery to Conc 3+4 by 0.3%.

The results in terms of increasing copper recovery are considered significant as the copper that is traditionally not recovered in the flotation process is always elusive. In other words, the present invention recovered 13.5% of the copper not recoverable by the traditional flotation procedure.

It will be recognised by persons skilled in the art that the present invention provides a significant advance over the prior art. By the use of this dual conditioning/flotation process, one can recover minerals of different mineralogical character from an ore in a single continuous process. Further, the use of a single gas separation plant to provide the required conditioning gases from air avoids the need for separate and costly supply of the oxidising gas or inert/non-oxidising gas or indeed wastage of one of these gases.

It will be appreciated that the method may be embodied in other forms without departing from the spirit or scope of the present invention.

What is claimed is:

1. A process for the recovery of valuable minerals of different mineralogical character from an ore wherein the process comprises:

subjecting a milled slurry or flotation concentrate to a first conditioning step followed by a first flotation step to recover a valuable mineral from the slurry or concentrate, withdrawing a tailing stream from the first flotation step, subjecting the tailing stream to a second conditioning step followed by a second flotation step to recover any valuable mineral in the tailing stream, wherein the first conditioning step comprises conditioning the slurry or the flotation concentrate with an oxidising gas containing a gas selected from the group consisting essentially of oxygen and ozone, and the second conditioning step comprises conditioning the slurry or the flotation concentrate with a substantially non-oxidising gas and an oxidisable surface modifying reagent.

2. A process as claimed in claim 1 further comprising tailoring the first and second conditioning steps, and the first and second flotation steps to the ore being subjected to the process.

3. A process as claimed in claim 1 wherein the oxidising gas and the substantially non-oxidising gas are generated from ambient air by a single air separation plant.

4. A process as claimed in claim 3 wherein the ore contains a mixture of valuable minerals from the group consisting of sulphidic minerals and non-sulphidic minerals, and non-valuable minerals from the group consisting of sulphidic materials and gangue materials.

5. A process as claimed in claim 3 wherein the oxidising gas is selected from the group consisting of oxygen, oxygen-enriched air and ozone.

6. A process as claimed in claim 1 wherein the substantially non-oxidising gas is selected from the group consisting of nitrogen, argon, carbon dioxide, sulphur dioxide and admixtures thereof.

7. A process as claimed in claim 1 wherein the oxidisable surface modifying reagent is selected from the group consisting of sodium hydrosulphide, sodium sulphide, hydrogen sulphide, ammonium sulphide, and ammonium hydrosulphide.

8. A process as claimed in claim 1 wherein the oxidisable surface modifying reagent is selected from the group consisting of sulphoxy agents including sodium sulphite, sodium hydrogen sulphite, sodium metabisulphite, sodium bisulphite, sulphur dioxide gas, sulphur dioxide solution, sulphide agents, and potassium, calcium and ammonium salts thereof.

9. A process as claimed in claim 1 wherein the oxidising gas and the substantially non-oxidising gas are generated from ambient air by a single air separation plant.

* * * * *